United States Patent [19]

Sorenson et al.

[11] 4,236,740

[45] Dec. 2, 1980

[54] FILE BOX

[75] Inventors: John F. Sorenson, St. Paul; Frank W. Locke, Minneapolis, both of Minn.

[73] Assignee: Champion International Corporation, Stamford, Conn.

[21] Appl. No.: 55,971

[22] Filed: Jul. 9, 1979

[51] Int. Cl.[3] ..... B65D 5/30; B65D 5/22

[52] U.S. Cl. ..... 229/36; 229/33; 229/31 FS; 229/45R

[58] Field of Search ..... 229/33, 34 R, 36, 44, 229/45, 31 FS

[56] References Cited

U.S. PATENT DOCUMENTS

| | | | |
|---|---|---|---|
| 1,600,260 | 9/1926 | Walter | 229/36 |
| 1,616,014 | 2/1927 | Walter | 229/33 |
| 2,736,487 | 2/1956 | George | 229/45 |
| 2,942,770 | 6/1960 | Eichorn | 229/33 |
| 3,883,067 | 5/1975 | McGlynn et al. | 229/31 FS |
| 3,940,053 | 2/1976 | Putman et al. | 229/44 R X |
| 4,082,215 | 4/1978 | Eichenauer | 229/33 X |
| 4,119,265 | 10/1978 | Dlugopolski | 229/31 FS |
| 4,148,429 | 4/1979 | Burr et al. | 229/31 FS |

FOREIGN PATENT DOCUMENTS

| | | | |
|---|---|---|---|
| 2363489 | 3/1978 | France | 229/33 |

*Primary Examiner*—Davis T. Moorhead
*Attorney, Agent, or Firm*—Evelyn M. Sommer

[57] ABSTRACT

A box for storing files is formed from a single blank of paperboard. The blank consists of a centrally located bottom wall panel having side wall panels foldably connected thereto. Each of the centrally located bottom wall panel and side wall panels have an end wall panel extending from a transverse edge thereof so that when the side wall panels are folded 90° relative to the bottom wall panel, the end wall panels on the transverse edges of the side walls and bottom wall can be overlapped and locked together. Connected to the outer longitudinal edges of each of the side wall panels is a top wall panel substantially half the width of the centrally located bottom panel. The top wall panels are adapted to be folded 90° relative to the side walls to form a cover for the box. Longitudinally extending tabs extend from the transverse edges of each of the top wall panels and can be inserted within an opening in the end walls to lock the top wall panels in place on the box.

6 Claims, 7 Drawing Figures

Fig. 1
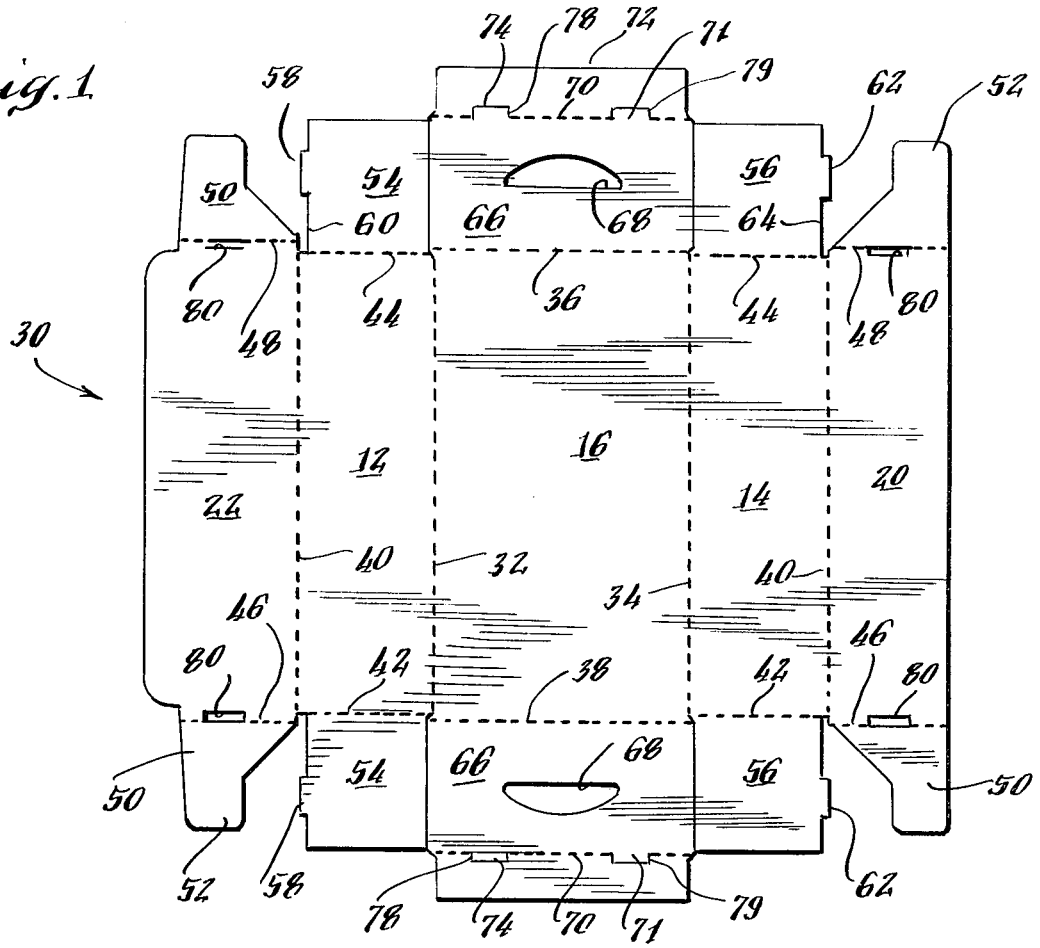
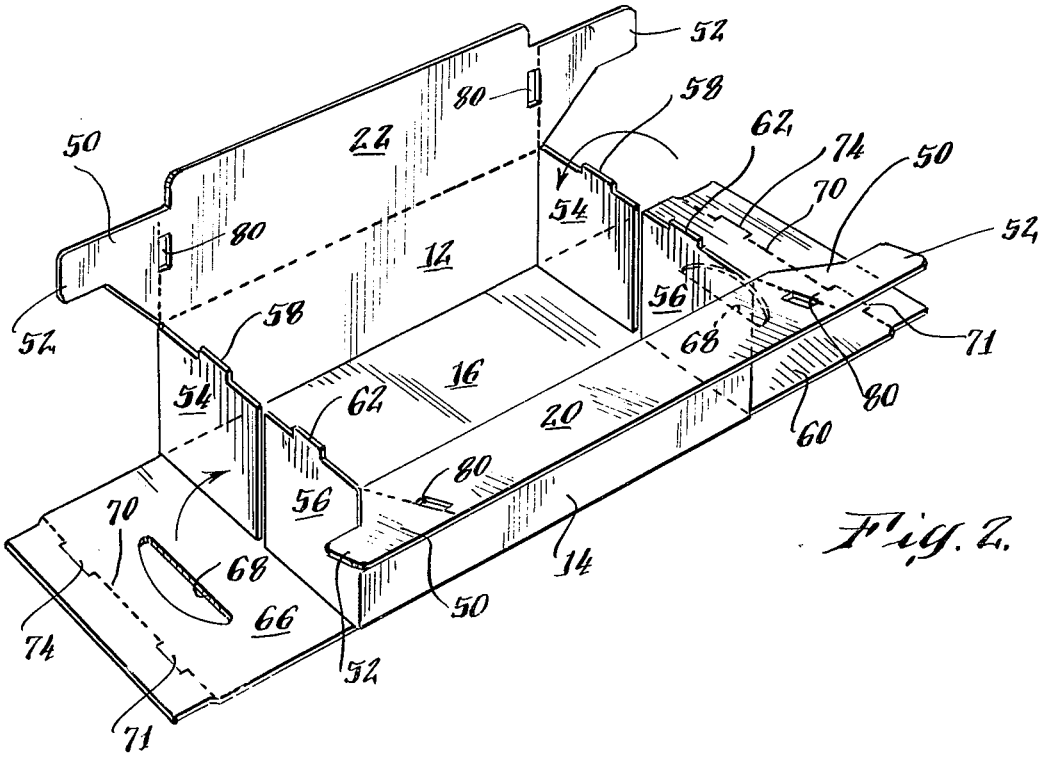
Fig. 2.

FILE BOX

BACKGROUND AND SUMMARY OF THE INVENTION

This invention relates to a box construction, and more particularly, a box construction adapted for use in the storage of files and documents.

Heretofore, file storage boxes were cumbersome and were usually formed from two parts; a bottom which retained the files and documents and a separate cover for enclosing the documents so they can be stored within the box. The box had to be formed from strong materials such as steel or corrugated paperboard in order to hold the heavy weight of the stored files. This essentially precluded the box construction from being made from a single blank of foldable paperboard material as the requisite strength could not be attained.

The present invention, however, provides a storage file box which can be quickly assembled from one-piece of paperboard material. The result is a box construction which has the requisite strength for holding heavy contents such as files and other papers is quickly and easily assembled and can be shipped in a flat or knocked down condition. The one-piece blank also precludes the necessity of supplying a separable cover element as the cover is formed integral with the bottom and side end wall-forming portions of the one-piece blank.

In accordance with the invention, a box for storing files is formed from a single blank of paperboard. The blank consists of a centrally located bottom wall panel having side wall panels foldably connected thereto. Each of the centrally located bottom wall panels and side wall panels have an end wall panel extending from a transverse edge thereof so that when the side wall panels are folded 90° relative to the bottom wall panel, the end wall panels on the transverse edges of the side walls and bottom walls can be overlapped and locked together. Connected to the outer longitudinal edges of each of the side wall panels is a top wall panel substantially half the width of the centrally located bottom panel. The top wall panels are adapted to be folded 90° relative to the side walls to form a cover for the box. Longitudinally extending tabs extend from the transverse edges of each of the top wall panels and can be inserted within an opening in the end walls to lock the top wall panels in place on the box.

Each of the end panels connected to the side walls include upright tabs when folded into an abutting position. A third end panel foldably connected to the bottom panel of the box blank is then overlapped with the first pair of abutting end panels connected to the side wall panels and includes a foldable portion intermediate its transverse edges. This portion of the third end panel includes die cut slots so that when the portion is folded relative to the third end panel, the upright tabs on the abutting first pair of end panels extends through the slots to lock the end panels together to form a two-ply construction for reinforcing the box.

The third end panel also includes a half moon opening for receiving the extended tabs of the top panels for holding the top panels locked together to form a closure for the box.

BRIEF DESCRIPTION OF THE DRAWINGS

Further objects and advantages of the invention will become apparent from the following description and claims, and from the accompanying drawings, wherein:

FIG. 1 is a top plan view of a blank for forming the box of the present invention;

FIGS. 2 to 5, inclusive, are perspective views of the blank of FIG. 1 being successively folded to form the box of the present invention;

DETAILED DESCRIPTION OF THE PREFERRED EMBODIMENT

Figure 3:
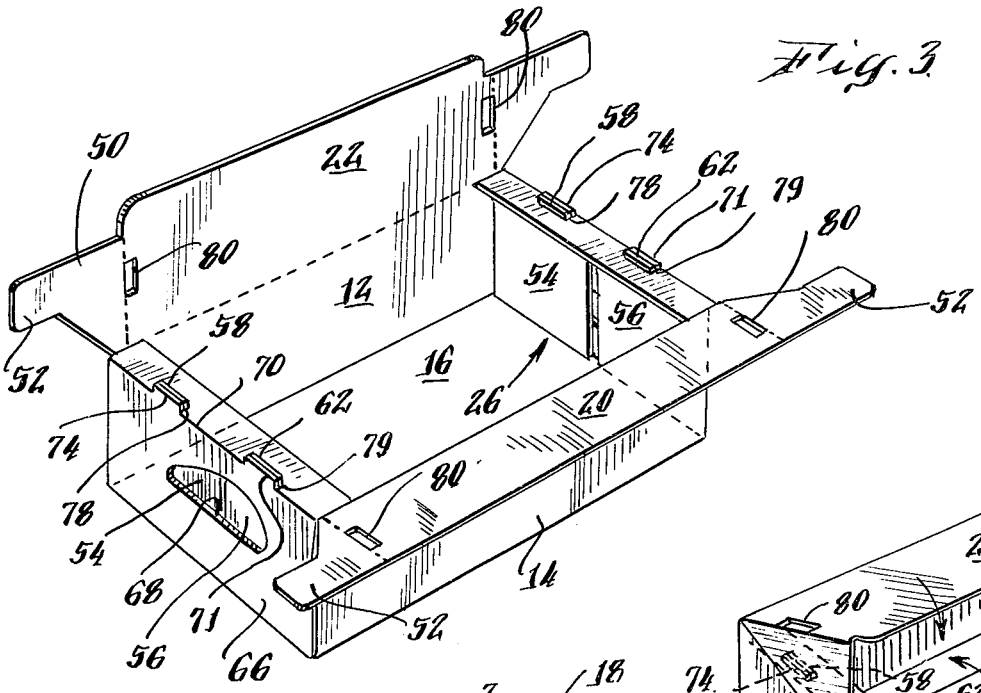
Figure 4:
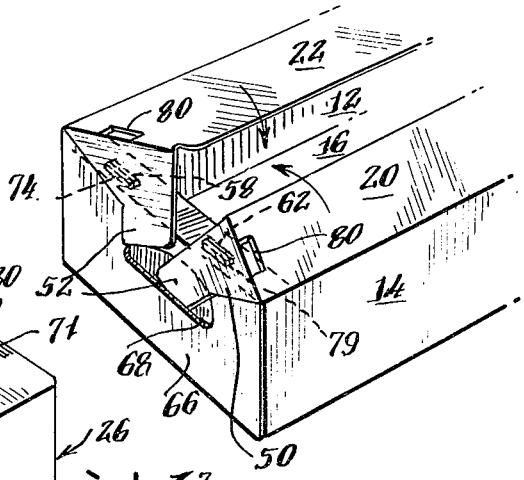
Figure 5:
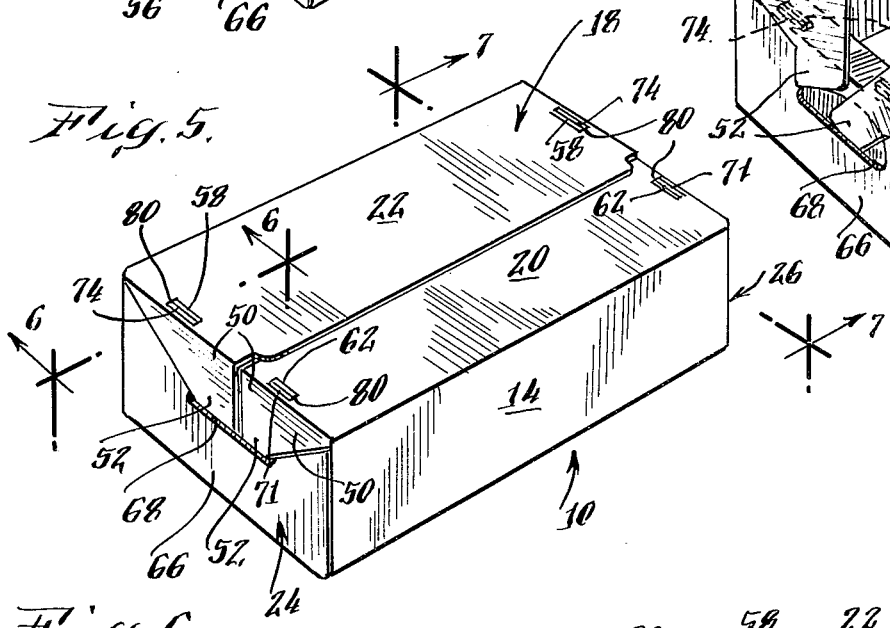
Figure 6:
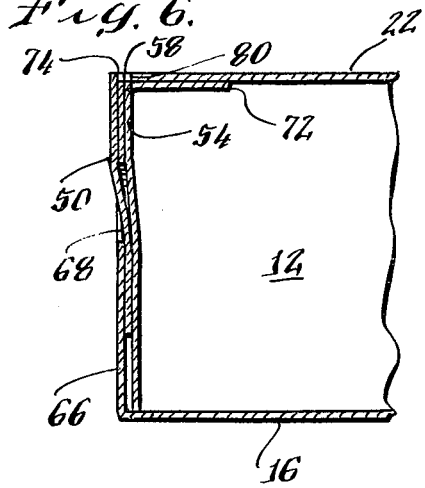
FIG. 6 is a partial cross-sectional view of the box of the present invention taken substantially along the plane indicated by line 6—6 of FIG. 5.
Figure 7:
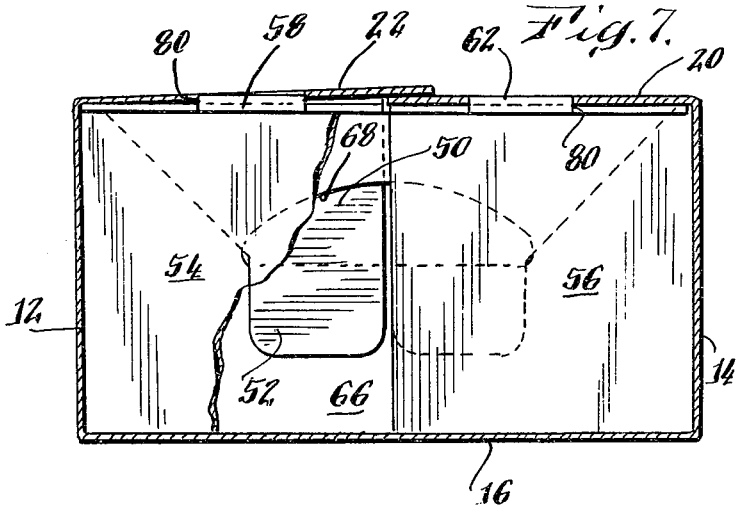
FIG. 7 is a cross-sectional view of the box of the present invention taken substantially along the plane indicated by line 7—7 of FIG. 5.

Referring now to the drawings in detail wherein like numerals indicate like elements throughout the several views, the file storage box of the present invention is indicated in FIG. 5 by the number 10.

The box 10 includes a pair of opposed side walls 12 and 14, a bottom wall 16, and a top wall 18, formed from a pair of panels 20 and 22. Opposed end walls 24 and 26 between the side walls and the bottom and top wall complete the construction. Each end wall 24 and 26 is of a two-ply construction for maximum strength while the cover panels 20 and 22 are formed integral with the side walls 12 and 14 thereby precluding the necessity of providing a separate cover element for the box.

The storage box 10 is formed from a planar one-piece paperboard blank 30, as illustrated in FIG. 1.

The blank 30 includes a centrally located bottom wall forming panel 16 having opposed, longitudinal edges 32 and 34 and opposed transverse edges 36 and 38. Foldably connected to longitudinal edge 34 of panel 16 is the side wall forming panel 14. Foldably connected to the longitudinal edge 32 of panel 16 is the side wall forming panel 12.

Each of the side wall forming panels 12 and 14 include longitudinal edges 40 parallel to longitudinal edge 32 (in the case of panel 12) and edge 34 (in the case of panel 14). The panels 12 and 14 also include parallel transverse edges 42 and 44.

Foldably connected to the longitudinal edge 40 of panel 12 is the top forming panel 22. Similarly, foldably connected to edge 40 of panel 14 is a top forming panel 20. Panels 20 and 22 are substantially one half the width of centrally located bottom panel 16 of blank 30, except that panel 22 is slightly wider for the purpose which will become apparent hereinafter.

Each of the top-forming panels 20 and 22 include opposed, parallel transverse edges 46 and 48. A longitudinally extending tab 50, basically in the shape of a right triangle, projects upwardly and downwardly from the edges 48 and 46 of the panels 20 and 22, respectively.

Connected to the transverse scorelines 44 of side wall panels 12 and 14, respectively, are end panels 54 and 56, respectively. Panels 54 and 56 are substantially identical in that they are rectangular in shape. Panel 54 includes a rectangular tab 58 extending from the outermost edge 60 of the panel while a similar rectangular tab 62 extends outwardly from the outermost edge 64 of panel 56. A similar panel 56 is foldably connected to the lower transverse edge 42 of side wall panel 14, while a panel 54 is foldably connected to transverse edge 42 of side wall panel 12.

Foldably connected to the upper transverse edge 36 and the lower transverse edge 38 of central bottom panel 16 is a third end wall panel 66. End wall panel 66 includes a centrally located half-moon shaped opening 68. A transverse scoreline 70 is provided on panel 66 intermediate its bottom transverse edge 36 or 38 and its outermost edge 72. Die cut along spaced portions of scoreline 70 are two series of cut lines forming 3 sides of a rectangular die cut portion 71 and 74. When the end panel 66 is folded about scoreline 70, a pair of apertures 78 and 79 will be formed by movement of the panel material between outermost edge 72 and scoreline 70 relative to the die cut portions 71 and 74.

A rectangular slot 80 is cut along the transverse edge 48 of each of the top panels 20 and 22, respectively, as well as along the bottom transverse edge 46 of each of the panels, to complete the construction of the blank 30.

FIGS. 2 to 5 indicated how the blank 30 is folded to form box 10.

Side wall panels 12 and 14 are folded 90° about longitudinal edges or foldlines 32 and 34 to a substantially upright position. End wall panels 54 and 56 connected to each of the transverse foldlines 42 and 44, respectively at each end of the side wall panels are then folded 90° relative to the side wall panels so as to abut as indicated in FIG. 2. The third end wall panel 66 is then overlapped with the panels 54 and 56 at each end of box 10 by folding panel 66 90° about transverse foldline 36 or 38 (see FIGS. 2 and 3). Panel 66 is then folded intermediate its ends about transverse scoreline 70, forming the apertures 78 and 79 by virtue of being folded 90° about the die cut portions 74 and 71, respectively. The apertures 78 and 79 receive respectively, the tabs 58 and 62 on the end panels 54 and 56, respectively, thereby locking the three end panels 54, 56 and 66 together in a two-ply construction to form a unitary end wall of increased strength (see FIG. 3).

Files or other paper material may then be loaded and disposed within the interior of box 10. In order to cover the same, top wall panels 20 and 22, are folded 90° respectively, relative to side wall panels 14 and 12, respectively, into overlying relation to the interior of box 10 and into abutting relation with the portions of the end panels 66 folded between transverse scoreline 70 and the outer edge 72 of the panel. Panel 22 is slightly greater in width than panel 20 so that panel 20 is first folded and then panel 22 can overlap the same to form a complete closure at the top of box 10.

The triangular tabs 50 at the top and bottom of each of the top wall panels 20 and 22 can then be folded 90° relative to the top panels about edges 46 or 48. The tongues 52 of each tab 50 can be inserted within the adjacent half moon slot 58 in the adjacent end panel 66. (see FIGS. 4 and 5).

When the triangular extension tabs 50 are inserted within the half moon slots 68 in the adjacent end panel 66, the opening 80 in the top wall panel 20 and 22 receives one of the extension tabs 58 or 62 in the end panels 54 and 56, respectively, along with its complemental die cut portion 74, 71, therethrough, to further rigidify the resultant box construction. While box construction 10 has been disclosed specifically for use as a file storage box, it will be apparent that box 10 can be used as a reinforced container for other products such as meat, vegetables or for dispensing retail products. Accordingly, no limitation of use should be attached to the box in the corresponding claims.

What is claimed as new is:

1. A box comprising:

a bottom wall having a first and second pair of opposed, parallel edges, a side wall connected to each of the first pair of opposed edges of said bottom wall, an end wall connected to each of the second pair of opposed edges of said bottom wall, each of said end walls including a pair of abutting end panels, each of said abutting end panels being connected to an edge of one said side walls, and a third end panel connected to one of said second pair of opposed edges of said bottom wall overlapping said pair of abutting end panels, a top flap for forming a top wall for said box connected to an edge of each of said side walls, the third end panel of each end wall including an opening, each of said top flaps including a bendable tab extension extending from opposite ends thereof received within said opening in each of said third panels of each end wall, and said end panels having means therebetween for locking said end panels together, said locking means including an upright tab on the top edge of each of said pair of abutting end panels, a pair of spaced openings for receiving said upright tabs cut in said third end panel along a foldline spaced intermediate spaced transverse edges thereof, and each of said top flaps including an opening cut therein adjacent each end thereof for also receiving an upright tab of one of said pair of abutting end panels.

2. The box of claim 1 wherein one of said top flaps is wider than the other so as to overlap to form said top wall.

3. A one-piece, planar, paperboard blank for forming the box of claim 1.

4. A one-piece, planar, paperboard blank for forming the box of claim 2.

5. A blank for forming a box comprising a central, substantially rectangular panel having opposed longitudinal and transverse edges, a substantially rectangular side panel foldably connected to each of the longitudinal edges of said central panel, each of said side panels having opposed longitudinal and transverse edges, a substantially rectangular top and bottom panel foldably connected to opposed transverse edges of each of said side panels, a substantially rectangular panel connected to each of the transverse edges of said central rectangular panel, a substantially rectangular panel approximately half the width of said central panel foldably connected to a longitudinal edge of each of said side panels, said half-width panels having opposed longitudinal and transverse edges, an elongated tab foldably connected to each transverse edge of each of said half-width panels, said rectangular panel foldably connected to each of the transverse edges of said central panel having a substantially centrally located opening cut therein, the rectangular panel connected to each of the transverse edges of said central panel including a foldline spaced intermediate spaced transverse edges thereof, and a pair of cut lines extending upwardly from said foldline for forming a pair of spaced openings along said foldline, and each of said substantially rectangular panels foldably connected to a longitudinal edge of each of said side panels including an opening cut therein adjacent each end thereof.

6. The blank of claim 5 wherein one of said half-width panels is wider than the other.

* * * * *